US006592499B2

(12) United States Patent
Parker

(10) Patent No.: US 6,592,499 B2
(45) Date of Patent: Jul. 15, 2003

(54) EXERCISE APPARATUS

(75) Inventor: Larry M. Parker, 2931 Honors Row, Owens Cross Roads, AL (US) 35763

(73) Assignee: Larry M. Parker, Owens Cross Roads, AL (US)

( * ) Notice: Subject to any disclaimer, the term of this patent is extended or adjusted under 35 U.S.C. 154(b) by 0 days.

(21) Appl. No.: 09/897,850

(22) Filed: Jul. 2, 2001

(65) Prior Publication Data

US 2003/0004040 A1 Jan. 2, 2003

(51) Int. Cl.[7] ..... A63B 21/072; A63B 21/075
(52) U.S. Cl. ..... 482/106; 482/107
(58) Field of Search ..... 482/104, 106, 482/107, 108, 148

(56) References Cited

U.S. PATENT DOCUMENTS 4,252,316 A * 2/1981 Price ..... 272/123
4,618,142 A * 10/1986 Joseph, Jr. ..... 272/75
4,647,038 A * 3/1987 Noffsinger ..... 272/123
5,163,887 A 11/1992 Hatch
5,464,379 A * 11/1995 Zarecky ..... 482/108
5,496,243 A * 3/1996 Allen ..... 482/106
5,591,109 A 1/1997 Strnad
5,697,871 A 12/1997 Landfair
5,911,651 A 6/1999 Liu
6,007,268 A 12/1999 Whittington et al.
6,315,699 B1 * 11/2001 Romero ..... 482/107

* cited by examiner

*Primary Examiner*—Nicholas D. Lucchesi
*Assistant Examiner*—Lori Baker Amerson
(74) *Attorney, Agent, or Firm*—Tarolli, Sundheim, Covell, & Tummino L.L.P.

(57) ABSTRACT

An apparatus (10) that is used for exercising includes a barbell (12) having a longitudinal axis (14) and first and second axial ends (16, 18). First and second dumbbells (30, 32) are releasably connectable to the first and second axial ends (16, 18) of the barbell (12). Each of the first and second dumbbells (30, 32) has weighted opposite end portions (40, 42) and a handle (44) extending between the weighted opposite end portions (48, 50). Locking members (62) releasably connect the first and second dumbbells (30, 32) to the first and second axial ends (16, 18) of the barbell (12) so that longitudinal axes (14) of the first and second dumbbells (30, 32) are coaxial with the longitudinal axis (14) of the barbell (12). Each of the locking members (62) has a locking position in which the dumbbells (30, 32) are connected to the barbell (12).

15 Claims, 3 Drawing Sheets

10
30
42
44
40
48
66
94
96
90
62
70
72
64
76
16
12
22
24
18
14
32

EXERCISE APPARATUS

FIELD OF THE INVENTION

The present invention relates to an apparatus that is used for exercising, and more specifically, to an exercise apparatus for weight training having a barbell with dumbbells releasably connected to axial ends of the barbell.

BACKGROUND OF THE INVENTION

A known exercise apparatus is disclosed in U.S. Pat. Nos. 5,496,243, 5,496,243 discloses an exercise apparatus having brackets attached to each end of a barbell for connecting dumbbells to the barbell. The dumbbells have handles between a pair of weighted ends. The handles of the dumbbells are sized to fit into the brackets and to be removably latched in the brackets. The longitudinal axes of the dumbbells extend transverse to the longitudinal axis of the barbell when the handles are latched to the brackets.

SUMMARY OF THE INVENTION

An apparatus that is used for exercising includes an elongated barbell having a longitudinal axis and first and second axial ends. First and second dumbbells having longitudinal axes are releasably connectable to the first and second axial ends of the barbell. Each of the first and second dumbbells has weighted opposite end portions and a handle extending between the weighted opposite end portions.

Locking members releasably connect the first and second dumbbells to the first and second axial ends of the barbell so that longitudinal axes of the first and second dumbbells are coaxial with the longitudinal axis of the barbell. Each of the locking members has a locking position in which the dumbbells are connected to the barbell. Accordingly, the dumbbells can be disconnected from the barbell for storage and handling of the apparatus.

BRIEF DESCRIPTION OF THE DRAWINGS

The foregoing and other features of the present invention will become apparent to one skilled in the art to which the present invention relates upon consideration of the following description of the invention with reference to the accompanying drawings, in which.

DESCRIPTION OF THE INVENTION

Figures 1, 2:
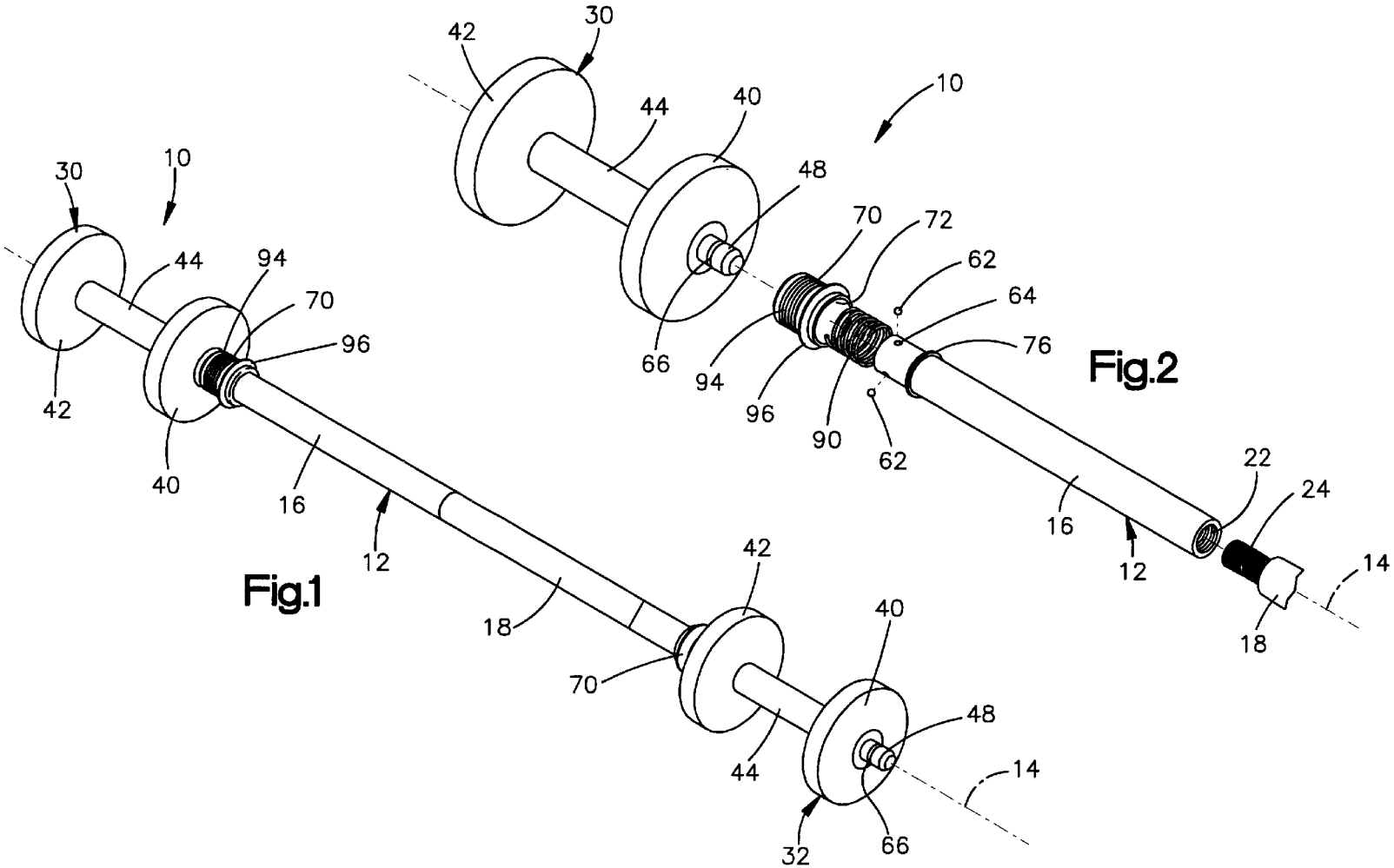
FIG. 1 is a schematic pictorial view of an exercise apparatus constructed in accordance with a first embodiment of the present invention.
FIG. 2 is an exploded view of a portion of the exercise apparatus of FIG. 1.
Figures 3, 4:
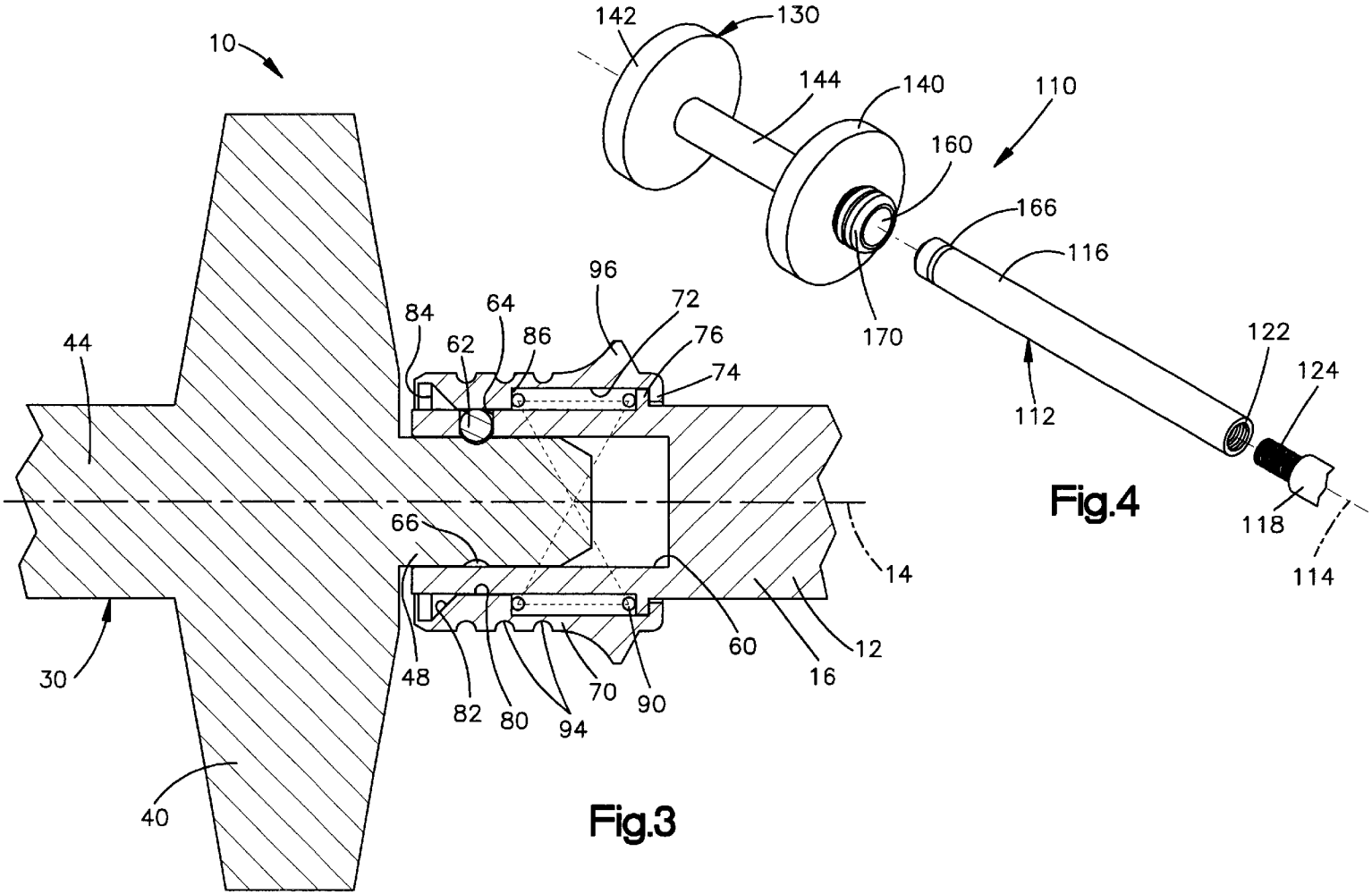
FIG. 3 is a cross-sectional view of a portion of the apparatus of FIG. 1 showing a dumbbell releasably connected to a barbell of the apparatus.
FIG. 4 is an exploded view of a portion of an exercise apparatus constructed in accordance with a second embodiment of the present invention.

An exercise apparatus 10 constructed according to a first embodiment of the present invention is illustrated in FIGS. 1–3. The exercise apparatus 10 is used for weight training and includes an elongate barbell 12 having a longitudinal axis 14. The barbell 12 (FIGS. 1 and 2) has first and second axial ends 16 and 18 releasably connected to each other. The axial end 16 (FIG. 2) of the barbell 12 has a threaded opening 22. A threaded portion 24 on the axial end 18 threadably engages the threaded opening 22. Accordingly, the axial ends 16 and 18 can be disconnected from each other for storage and handling.

Dumbbells 30 and 32 (FIGS. 1 and 2) are releasably connectable to the first and second axial ends 16 and 18 of the barbell 12. The dumbbells 30 and 32 are identical and, therefore, only dumbbell 30 will be described in detail. The dumbbell 30 has weighted opposite end portions 40 and 42 and a handle 44 extending between the weighted opposite end portions. The handle 44 can be grasped by a person for weight training when the dumbbell 30 is disconnected from the barbell 12.

The dumbbell 30 has connecting portions 48 (one of which is shown in FIGS. 2 and 3) extending axially from the weighted opposite end portions 40 and 42 and away from the handle 44. The connecting portions 48 are releasably connectable with the first and second axial ends 16 and 18 of the barbell 12. The connecting portions 48 are connectable with the barbell 12 so that longitudinal axes of the dumbbells are coaxial with the longitudinal axis 14 of the barbell.

The connecting portions 48 (FIG. 3) of the dumbbells 30 and 32 extend into axially extending openings 60 in the axial ends 16 and 18 of the barbell 12. Locking members or balls 62 (FIGS. 2 and 3) extend through radial openings 64 in the barbell 12 and into the openings 60. The locking members 62 engage annular grooves 66 on the connecting portions 48 of dumbbells 30 and 32. The locking members 62 have locking positions in which the locking members extend through the openings 64 and engage the grooves 66 to connect the dumbbells 30 and 32 to the barbell 12. The present invention shows three locking members 62 for connecting the dumbbell 30 to the axial end 16. It is contemplated that any number of locking members 62 could be used.

Collars 70 (FIGS. 1–3) retain the locking members 62 in the locked positions when the dumbbells 30 and 32 are connected to the barbell 12. The collars 70 (FIG. 3) have axially extending openings 72 which receive the axial ends 16 and 18 of the barbell 12. Axial end portions 74 of the collars 70 are swaged around radially extending flanges 76 on the axial ends 16 and 18. The radially extending flanges 76 retain the collars 70 on the barbell 12.

Each of the collars 70 (FIG. 3) includes a radially inner cylindrical surface 80 that engages the locking members 62 to retain the locking members in the locking positions. The collars 70 also include frustoconical surfaces 82 defining annular recesses 84 into which the locking members 62 move upon release of the dumbbells 30 and 32 from the barbell 12. A spring 90 extends between the radially extending flange 76 on the barbell 12 and a shoulder 86 in the collar 70. The spring 90 biases the collar 70 into a position in which the surface 80 engages the balls 62. Accordingly, the spring 90 biases the collars 70 into a position in which the collars retain the locking members 62 in the locking positions.

The collars 70 also include radially outer grooves 94 for manually gripping the collar 70 to move the collar axially relative to the barbell 12. The collars 70 also include radially outwardly extending flanges 96. The grooves 94 and flanges 96 are manually engaged to move the collar 70 axially relative to the barbell 12.

When the dumbbell 30 is to be connected to the axial end 16 of the barbell 12, the collar 70 is manually moved axially relative to the axial end 16 toward the threaded opening 22. One of the connecting portions 48 of the dumbbell 30 is inserted into the opening 60 in the axial end 16 so that the longitudinal axis of the dumbbell is coaxial with the longitudinal axis 14 of the barbell 12. The connecting portion 48 engages the locking members 62 to move the locking members radially outward into the recess 84. When the groove 66 is aligned with the locking members 62, the locking members extend through the openings 64 and engage the groove.

The collar 70 is released and the spring 90 moves the collar axially away from the threaded opening 22 and toward the dumbbell 30. When the collar 70 moves axially away from the threaded opening 22, the frustoconical surface 82 of the collar engages the balls 62 to press the balls into the groove 66 on the dumbbell 30 and the surface 80 of the collar 70 moves into engagement with the locking members. Accordingly, the collar 70 holds the locking members 62 in the groove 66 to connect the dumbbell 30 to the barbell 12. The dumbbell 32 is connected to the axial end 18 of the barbell 12 in a similar manner.

When the dumbbell 30 is to be disconnected from the axial end 16, the collar 70 is manually moved axially away from the dumbbell. Upon movement of the collar 70 away from the dumbbell 30, the recess 84 aligns with the locking members 62. The dumbbell 30 is then moved axially away from the axial end 16. The locking members 62 move radially outward toward the recess 84 to permit removal of the dumbbell 30 from the axial end 16. The collar 70 is released and the spring 90 moves the collar into a position in which the surface 80 engages the locking members 62 to retain the locking members in the openings 64. The dumbbell 32 is disconnected from the axial end 18 in a similar manner. Accordingly, the dumbbells 30 and 32 can be disconnected from the barbell 12 and the axial ends 16 and 18 of the barbell can be disconnected from each other for storage and handling of the apparatus 10.

Figure 5:
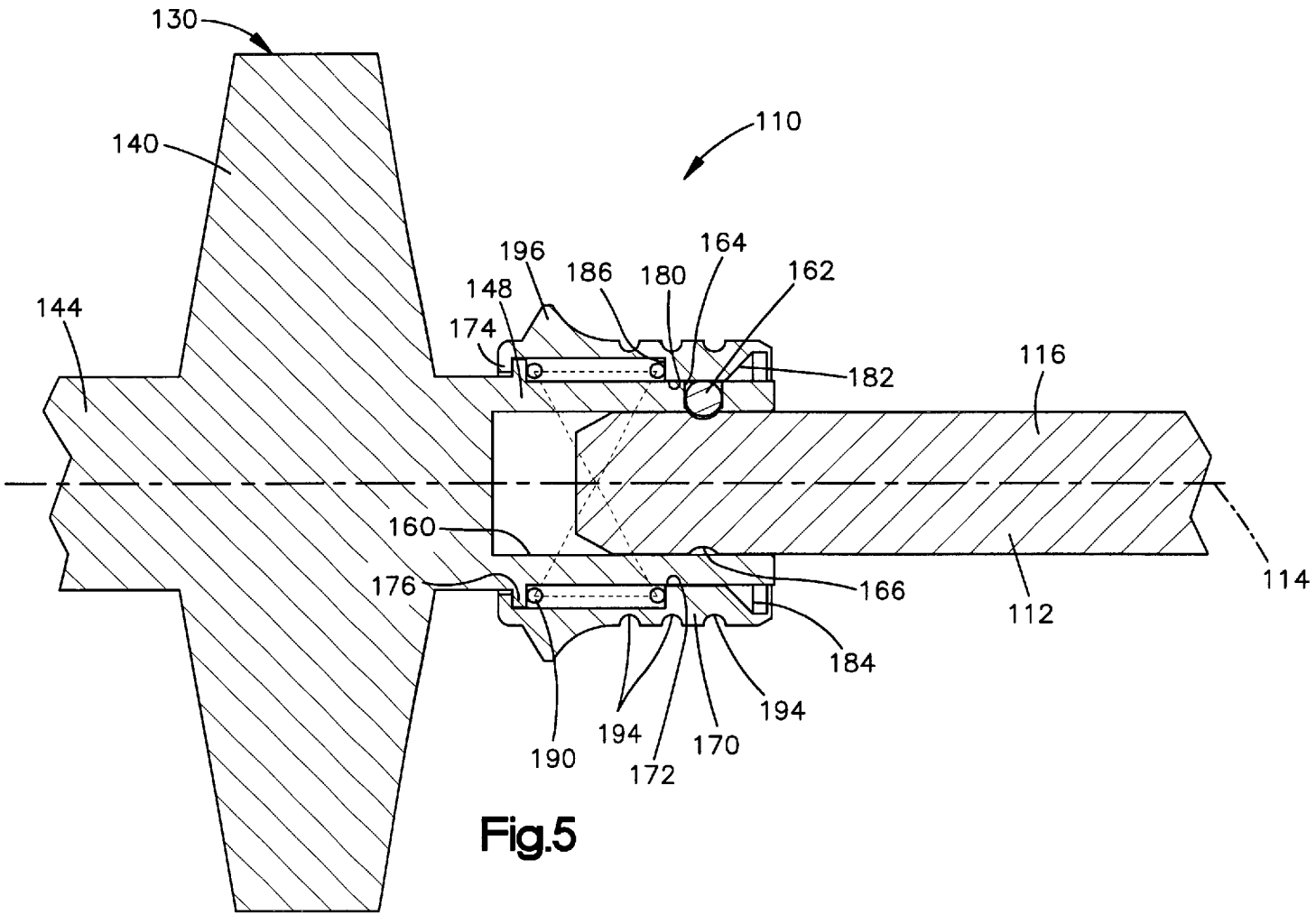
FIG. 5 is a cross-sectional view of a portion of the apparatus of FIG. 5 showing a dumbbell releasably connected to a barbell of the apparatus.

An exercise apparatus 110 constructed according to a second embodiment of the present invention is illustrated in FIGS. 4 and 5. The exercise apparatus 110 is substantially similar to the exercise apparatus 10 illustrated in FIGS. 1–3. A barbell 112 (FIG. 4) of the exercise apparatus 110 has a longitudinal axis 114 and axial ends 116 and 118 releasably connected to each other. The axial end 116 has a threaded opening 122. A threaded portion 124 on the axial end 118 threadably engages the threaded opening 122.

Dumbbells 130, one of which is shown in FIGS. 4 and 5, are releasably connectable to the axial ends 116 and 118 of the barbell 112. The dumbbell 130 (FIG. 4) has weighted opposite end portions 140 and 142 and a handle 144 extending between the opposite end portions. The dumbbell 130 has connecting portions 148, one of which is shown in FIG. 5, extending axially from the opposite end portions 140 and 142 and away from the handle 144. The connecting portions 148 are releasably connectable with the axial ends 116 and 118 of the barbell 112 so that the longitudinal axes of the dumbbells 130 are coaxial with the longitudinal axis 114 of the barbell 112.

The axial end 116 of the barbell 112 extends into an axially extending opening 160 in the connecting portion 148. Locking members or balls 162 extend through radial openings 164 in the connecting portion 148 and into the opening 160. The locking members 162 engage an annular groove 166 on the axial end 116. The locking members 162 have locking positions in which the locking members extend through the openings 164 and engage the groove 166 to connect the dumbbell 130 to the barbell 112.

A collar 170 retains the locking members 162 in the groove 166 on the barbell 112 when the dumbbell 130 is connected with the barbell. The collar 170 has an axially extending opening 172 which receives the connecting portion 148. Axial end portion 174 of the collar 170 is swaged around radially extending flange 176 on the connecting portion 148. The radially extending flange 176 retains the collar 170 on the dumbbell 130.

The collar 170 includes a radially inner cylindrical surface 180 that engages the locking members 162 to retain the locking members in the locking positions. The collar 170 also includes a frustoconical surface 182 defining a recess 184 into which the locking members 162 move upon release of the dumbbell 130 from the barbell 112. A spring 190 extends between the radially extending flange 176 on the dumbbell 130 and a shoulder 186 in the collar 170. The spring 190 biases the collar 170 into a position in which the surface 180 engages the balls 162. Accordingly, the spring 190 biases the collar 170 into a position in which the collar retains the locking members 162 in the locking positions.

The collar 170 also includes radially outer grooves 194 for manually gripping the collar 170 to move the collar axially relative to the dumbbell 130. The collar 170 also includes a radially outwardly extending flange 196. The grooves 194 and flange 196 are manually engaged to move the collar 170 axially relative to the dumbbell 130.

When the dumbbell 130 is to be connected to the axial end 116 of the barbell 112, the collar 170 is manually moved axially relative to connecting portion 148 toward the handle 144. The axial end 116 of the barbell 112 is inserted into the opening 160 in connecting portion 148. The axial end 116 engages the locking members 162 to move the locking members radially outward into the recess 184. When the groove 166 is aligned with the locking members 162, the locking members engage the groove. The collar 170 is released and the spring 190 moves the collar axially away from the handle 144. When the collar 170 moves axially away from the handle 144, the frustoconical surface 182 of the collar engages the balls 162 to press the balls into the groove 166 on barbell 112 and the surface 180 of the collar 170 moves into engagement with the locking members. Accordingly, the collar 170 holds the locking members 162 in the groove 166 to connect the dumbbell 130 to the barbell 112. The other dumbbell is connected to the axial end 118 of the barbell 112 in a similar manner.

When the dumbbell 130 is to be disconnected from the axial end 116, the collar 170 is manually moved axially toward the handle 144. Upon movement of the collar 170 toward the handle 144, the recess 184 aligns with the locking members 162. The dumbbell 130 is then moved axially away from the axial end 116. The locking members 162 move radially outward toward the recess 184 to permit the dumbbell 130 to be removed from the axial end 116. The other dumbbell 130 is disconnected from the axial end 118 in a similar manner. Accordingly, the dumbbells 130 can be disconnected from the barbell 112 and the axial ends 116 and 118 of the barbell can be disconnected from each other for easy storage and handling.

From the above description of the invention, those skilled in the art will perceive improvements, changes and modifications. Such improvements, changes and modifications within the skill of the art are intended to be covered by the appended claims.

Having described the invention, the following is claimed:

1. An apparatus that is used for exercising comprising:

an elongated barbell having a longitudinal axis and first and second axial ends;

first and second dumbbells releasably connectable to said first and second axial ends of said barbell, each of said first and second dumbbells having weighted opposite end portions and a handle extending between said weighted opposite end portions;

locking members for releasably connecting said first and second dumbbells to said first and second axial ends of said barbell so that longitudinal axes of said first and second dumbbells are coaxial with said longitudinal axis of said barbell, said locking members having locking positions in which said dumbbells are connected to said barbell, said locking members moving into said locking positions upon axial and non-rotational movement of said first and second dumbbells relative to said barbell; and first and second collars for retaining said locking members in said locking positions, each of said first and second collars being manually and axially movable relative to said first and second dumbbells from a first position in which said first and second collars retain said locking members in said locking positions to second positions in which said locking members are released from said locking positions.

2. An apparatus as defined in claim 1 wherein each of said first and second dumbbells has a connecting portion extending axially from one of said weighted opposite end portions and away from said handle, said connecting portions of said first and second dumbbells being releasably connectable with said first and second axial ends of said barbell.

3. An apparatus as defined in claim 2 wherein each of said first and second dumbbells has connecting portions extending axially from each of said weighted opposite end portions and away from said handle, each of said connecting portions of said first and second dumbbells being releasably connectable with said first and second axial ends of said barbell.

4. An apparatus as defined in claim 2 wherein said first and second axial ends of said barbell have axially extending openings into which said connecting portions of said first and second dumbbells extend.

5. An apparatus as defined in claim 4 wherein said locking members engage grooves on said connecting portions of said first and second dumbbells when said locking members are in said locking positions.

6. An apparatus as defined in claim 5 wherein said locking members extend through radial openings in said barbell into said grooves in said connecting portions of said first and second dumbbells.

7. An apparatus as defined in claim 6 wherein said first and second collars retain said locking members in said locking positions in said grooves, said first and second collars being manually and axially movable relative to said first and second dumbbells from first positions in which said locking members are retained in said locking positions by said first and second collars to second positions in which said locking members are released from said grooves.

8. An apparatus as defined in claim 7 wherein each of said first and second axial ends of said barbell has a radially extending flange, said springs engaging said radially extending flanges and said first and second collars to bias said first and second collars toward said first positions.

9. An apparatus as defined in claim 1 wherein said first axial end of said barbell is releasably connectable to said second axial end of said barbell.

10. An apparatus as defined in claim 9 wherein said first and second axial ends of said barbell are threadably connectable to each other.

11. An apparatus as defined in claim 7 wherein said locking members are engageable with grooves on said first and second dumbbells to connect said first and second dumbbells with said barbell.

12. An apparatus as defined in claim 1 wherein each of said first and second dumbbells has an axially extending opening into which said first and second axial ends of said barbell extend.

13. An apparatus that is used for exercising comprising:

an elongated barbell having a longitudinal axis and first and second axial ends;

first and second dumbbells releasably connectable to said first and second axial ends of said barbell, each of said first and second dumbbells having weighted opposite end portions and a handle extending between said weighted opposite end portions;

locking members for releasably connecting said first and second dumbbells to said first and second axial ends of said barbell so that longitudinal axes of said first and second dumbbells are coaxial with said longitudinal axis of said barbell, said locking members having locking positions in which said dumbbells are connected to said barbell;

each of said first and second dumbbells having connecting portions extending axially from each of said weighted opposite end portions and away from said handle, each of said connecting portions of said first and second dumbbells being releasably connectable with said first and second axial ends of said barbell;

said first and second axial ends of said barbell having axially extending openings into which said connecting portions of said first and second dumbbells extend;

said locking members engaging grooves on said connecting portions of said first and second dumbbells when said locking members are in said locking positions;

said locking members extending through radial openings in said barbell into said grooves in said connecting portions of said first and second dumbbells;

first and second collars retaining said locking members in said locking positions in said grooves, said first and second collars being manually and axially movable from first positions in which said locking members are retained in said locking positions by said first and second collars to second positions in which said locking members are released from said grooves; and springs biasing said first and second collars toward said first positions.

14. An apparatus that is used for exercising comprising:

an elongated barbell having a longitudinal axis and first and second axial ends;

first and second dumbbells releasably connectable to said first and second axial ends of said barbell, each of said first and second dumbbells having weighted opposite end portions and a handle extending between said weighted opposite end portions;

locking members for releasably connecting said first and second dumbbells to said first and second axial ends of said barbell so that longitudinal axes of said first and second dumbbells are coaxial with said longitudinal axis of said barbell, said locking members having locking positions in which said dumbbells are connected to said barbell;

first and second collars for retaining said locking members in said locking positions, each of said first and second collars being manually and axially movable from a first position in which said first and second collars retain said locking members in said locking positions to second positions in which said locking members are released from said locking positions; and springs biasing said first and second collars toward said first positions in which said barbell and said first and second dumbbells are connected to each other.

15. An apparatus that is used for exercising comprising:

an elongated barbell having a longitudinal axis and first and second axial ends;

first and second dumbbells releasably connectable to said first and second axial ends of said barbell, each of said first and second dumbbells having weighted opposite end portions and a handle extending between said weighted opposite end portions;

locking members for releasably connecting said first and second dumbbells to said first and second axial ends of said barbell so that longitudinal axes of said first and second dumbbells are coaxial with said longitudinal axis of said barbell, said locking members having locking positions in which said dumbbells are connected to said barbell;

each of said first and second dumbbells having an axially extending opening into which said first and second axial ends of said barbell extend;

first and second collars retaining said locking members in said locking positions, said first and second collars being manually and axially movable from first positions in which said locking members are retained in said locking positions by said first and second collars and second positions in which said locking members are released from said grooves; and springs biasing said first and second collars toward said first positions.

* * * * *